United States Patent [19]

Artz et al.

[11] Patent Number: 4,576,218

[45] Date of Patent: Mar. 18, 1986

[54] FEEDING DEVICE FOR INTRODUCING STEEL MELT INTO TWIN-BELT CASTERS

[75] Inventors: Gerd Artz, Ratingen; Gerhard Beckmann; Dieter Figge, both of Essen; Clemens Philipp, Meerbusch, all of Fed. Rep. of Germany

[73] Assignee: Fried. Krupp Gesellschaft mit beschränkter Haftung, Essen, Fed. Rep. of Germany

[21] Appl. No.: 724,809

[22] Filed: Apr. 19, 1985

[30] Foreign Application Priority Data

Apr. 21, 1984 [DE] Fed. Rep. of Germany ..... 3415235

[51] Int. Cl.[4] ..... B22D 11/02

[52] U.S. Cl. ..... 164/431; 164/438; 164/439; 222/607; 285/166; 285/370; 141/232; 141/284; 141/387

[58] Field of Search ..... 164/431, 434, 440, 488, 164/490, 437, 438, 439; 222/606, 607, 591; 285/166, 167, 370; 141/232, 284, 283, 387, 392

[56] References Cited

U.S. PATENT DOCUMENTS 3,478,813 11/1969 Cofer et al. ..... 164/434
4,456,054 6/1984 Henders ..... 164/440

FOREIGN PATENT DOCUMENTS 7713971 1/1979 France ..... 164/434

*Primary Examiner*—Nicholas P. Godici
*Assistant Examiner*—Samuel M. Heinrich
*Attorney, Agent, or Firm*—Spencer & Frank

[57] ABSTRACT

A feeding device for introducing molten steel into a twin-belt caster having mold walls which move exclusively in the casting direction. The feeding device comprises: a casting unit including a pouring pipe having a mouthpiece at one end which can extend between and form a sealing gap with the mold walls of a twin-belt caster, a first carriage moveable toward and away from a twin-belt caster and having the pouring pipe mounted thereon so that the pouring pipe is rotatable about a horizontal pivot axis and is laterally adjustable transversely to its longitudinal extent; a tundish mounted on a second carriage, which is disposed upstream of the first carriage and is independently moveable toward and away from the first carriage, so that the tundish is adjustable in height; and a compensating pipe for connecting the outlet of the tundish to the other end of the pouring pipe to permit molten steel to flow from the tundish through the pouring pipe. The compensating pipe has respective sealing surfaces at its opposed ends which respectively engage correspondingly shaped sealing surfaces on the other end of the pouring pipe and at the outlet of the tundish in a manner such that the engaging sealing surfaces are moveable relative to one another. The engaging sealing surfaces between the pouring pipe and the compensating pipe preferably form a ball joint and the engaging sealing surfaces between the compensating pipe and the tundish form a further ball joint or are two planar surfaces.

15 Claims, 9 Drawing Figures

FEEDING DEVICE FOR INTRODUCING STEEL MELT INTO TWIN-BELT CASTERS

CROSS REFERENCE TO RELATED APPLICATION

This application is related to copending U.S. application Ser. No. 06/592,457, filed Mar. 21, 1984, now U.S. Pat. No. 4,544,018.

BACKGROUND OF THE INVENTION

The present invention relates to a feeding device for introducing steel melt into twin-belt casters having mold walls which move exclusively in the casting direction, and which is of the type disclosed in German Patent Application P 33 11 090.5 corresponding to the above identified United States Patent Application. This feeding device includes a pouring body or pipe which is pivotal about a horizontal pivot axis and laterally displaceable transversely to its longitudinal dimension. Together with its own carriage, the pouring pipe forms its own pouring unit which is movable independently of a tundish disposed upstream of the pouring unit and of the twin-belt caster. Via the mouthpiece or spout of the pouring pipe, which extends to between the mold walls, the pouring pipe forms a sealing gap with the mold walls and can be connected to the movable, height adjustable tundish by way of a sealing surface in the form of a ball socket or ball pin or pivot which forms part of a ball joint.

The movable and adjustable arrangement of the pouring pipe makes it possible to separate it from the tundish and from the twin belt caster and thus heat the connecting members between the tundish and the twin belt caster, which are now accessible, by means of burners. Moreover, the mouthpiece of the pouring pipe, in view of its ball joint connection with the tundish, can be aligned with respect to the mold chamber of the twin belt caster in such a manner that it forms a sealing gap with the mold walls to prevent steel melt from escaping to the environment between mouthpiece and mold walls.

Proper operation of the feeding device, however, is assured only if the relative movement between the pouring pipe and the tundish meets with sufficient accuracy in the ball joint serving as the seal. When the applicable ceramic members of the tundish and of the pouring pipe are heated, thermal expansion occurs which may lead to unpredictable lateral, height and angular displacements. Although the mouthpiece of the pouring pipe can also be aligned with respect to the mold chamber after heating, it is impossible to determine whether, after heating, the position and configuration of the sealing surfaces forming the ball joint still meet the requirements. If this should not be the case, a gap remains in the region of the ball joint which usually necessitates termination of the casting process after a short period of time.

SUMMARY OF THE INVENTION

The present invention intends to further improve the feeding device of the above-mentioned type in such a way that it operates with the necessary operational security independently of possibly occurring deformations at cooperating components. In particular, it is to be possible to establish, via ceramic members that can be reused many times, a reliable, releasable connection between the tundish and the twin belt caster. That is, unpredictable, temperature caused displacement of the end points of the cooperating sealing surfaces should not have the result that the casting process must be prematurely terminated due to the escape of steel melt.

This is accomplished according to the present invention by a feeding device for introducing molten steel into a twin-belt caster having mold walls which move exclusively in the casting direction, which feeding device comprises: a casting unit including a pouring pipe having a mouthpiece at one end which can extend between and form a sealing gap with the mold walls of a twin-belt caster, a first carriage means disposed for movement toward and away from the locus of a twin-belt caster, and means for mounting the pouring pipe on the first carriage means so that the pouring pipe is rotatable about a horizontal pivot axis and is laterally adjustable transversely to its longitudinal extent; a tundish having an outlet; a second carriage means, disposed upstream of the first carriage means and independently moveable toward and away from the first carriage means, for supporting the tundish so that it is adjustable in height; and means for connecting the outlet of the tundish to the other end of the pouring pipe to permit molten steel to flow from the tundish through the pouring pipe, with the connecting means including a compensating pipe having first and second sealing surfaces at its opposed ends, first sealing means, including the first sealing surface and a cooperating correspondingly shaped sealing surface on the other end of the pouring pipe, for sealingly connecting the compensating pipe to the pouring pipe such that the first sealing surface and the sealing surface on the pouring pipe are moveable relative to one another, and a second sealing means, including the second sealing surface and a correspondingly shaped sealing surface at the outlet of the tundish, for sealingly connecting the compensating pipe to the tundish such that the second sealing surface and the sealing surface on the tundish are moveable relative to one another.

The basic idea of the invention is the use of a compensating pipe between the pouring pipe and the tundish so as to form a movable seal, not only with the pouring pipe in the area of its inlet, but also with the tundish in the area of its outlet. Preferably at least one of the two seals simultaneously serves as a coupling point for the sealing surfaces that cooperate at that location, i.e., the compensating pipe is not fastened to both the tundish and the pouring pipe. Thus, in addition to the already existing moveable seal, preferably in the form of a ball joint between the compensating pipe and the pouring pipe, a further movable seal is provided between the pouring pipe and the tundish by means of which any possibly occurring deformations during heating and cooling can be compensated.

According to further features of the invention the compensating pipe is fastened to and forms a moveable component of the pouring pipe and is preferably articulated to the pouring pipe. The coupling point which permits relative movement between the components is here disposed at the entrance of the compensating pipe between the compensating pipe and the tundish. Displacements between the pouring pipe and the tundish can thus be compensated to a greater extent according to one embodiment of the invention in that the cooperating sealing surfaces of the compensating pipe and of the tundish are planar surfaces. Due to the mobility of the ball joint at the exit seal of the compensating pipe, the two planar surfaces can each take on a position in which they form a seal which is reliable in operation and independent of displacements. For this purpose, it is sufficient to design the compensating pipe as a spherical segment having a short longitudinal dimension, i.e. as a ball pin or pivot which is followed immediately at the entrance side by the already mentioned planar surface.

According to a further feature of the invention, the compensating pipe equipped with a planar surface is preferably fastened to the pouring pipe by means of finger-like holding elements which engage with play in groove-shaped recesses in the surface of the compensating pipe. In this arrangement, the play between the finger-like holding elements and the groove-shaped recesses is dimensioned in such a manner that the compensating pipe can be pivoted with respect to the pouring pipe over the required angular range.

According to another advantageous embodiment of the present invention, the entrance seal as well as the exit seal of the compensating pipe are both composed of sealing surfaces which form respective ball joints. Due to the use of two ball joints, the compensating pipe is able to compensate any displacement occurring between the pouring pipe and the tundish, without leakages occurring in the region of the two seals.

In this latter embodiment of the invention, and according to a still further feature of the invention, the compensating pipe (which normally has a larger longitudinal dimension than the spherical segment embodiment having a planar surface) is supported by a supporting element in a height adjustable manner with respect to the tundish, with the supporting element itself being mounted on the carriage of the pouring pipe. The supporting element is advisably designed so that it holds the compensating pipe in the respectively desired height position. In particular, the compensating pipe may be held by a rope and pulley arrangement which is equipped with a counterweight serving for weight compensation.

According to another feature of the invention, the compensating pipe is equipped with a lateral adjustment unit for changing the lateral position of the compensating pipe with respect to the tundish. A particularly simple design of a lateral adjustment unit is a continuous rope or cable which is fastened to the compensating pipe and is supported via guide rollers mounted on an adjacent structure, i.e., the pouring pipe and/or its carriage.

Finally, according to another feature of the invention, one of the sealing surfaces of the two seals on the pouring pipe, the compensating pipe or the tundish is preferably covered by a fiber mat which is composed essentially of $Al_2O_3$ and $SiO_2$.

BRIEF DESCRIPTION OF THE PREFERRED EMBODIMENTS

The present invention will now be described in greater detail with reference to a plurality of embodiments which are illustrated in the drawings.

Figure 5A:
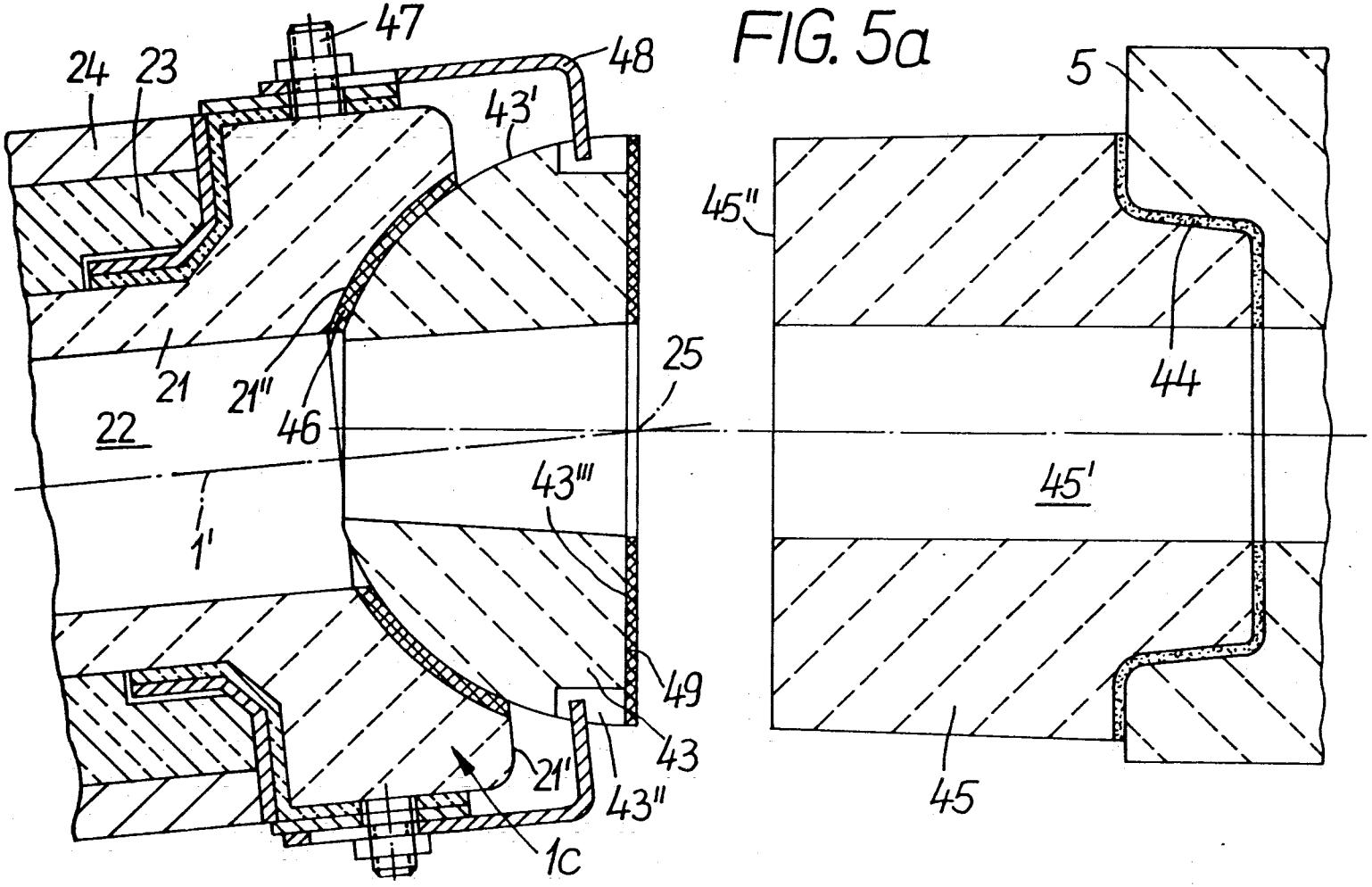
Figure 5B:
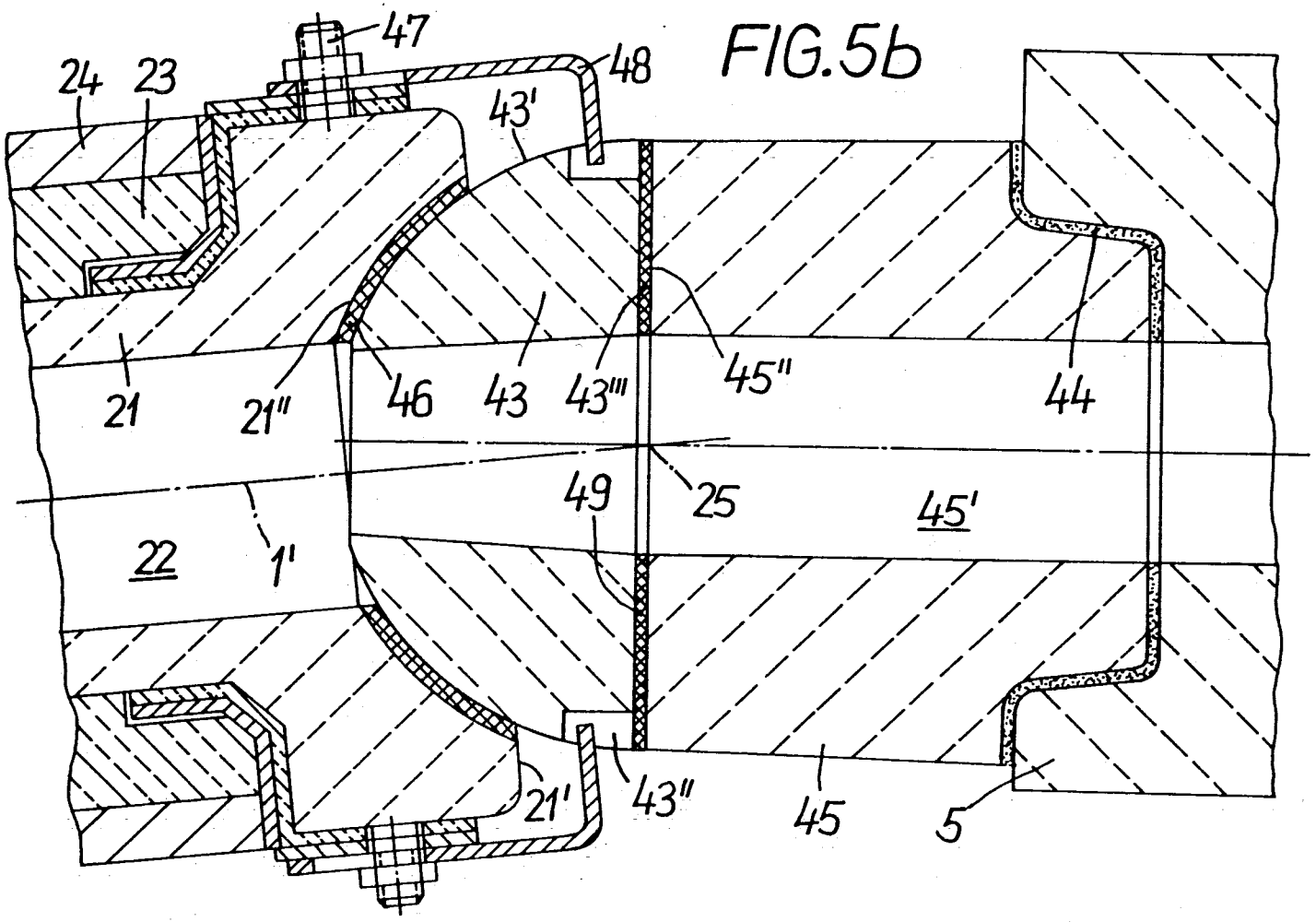

FIGS. 5*a* and 5*b* are partial sectional views showing a compensating pipe for the connection between the tundish and the pouring tube according to one embodiment of the invention, i.e., in the form of a spherical segment, in the uncoupled and in the coupled state, respectively.

Figure 6A:
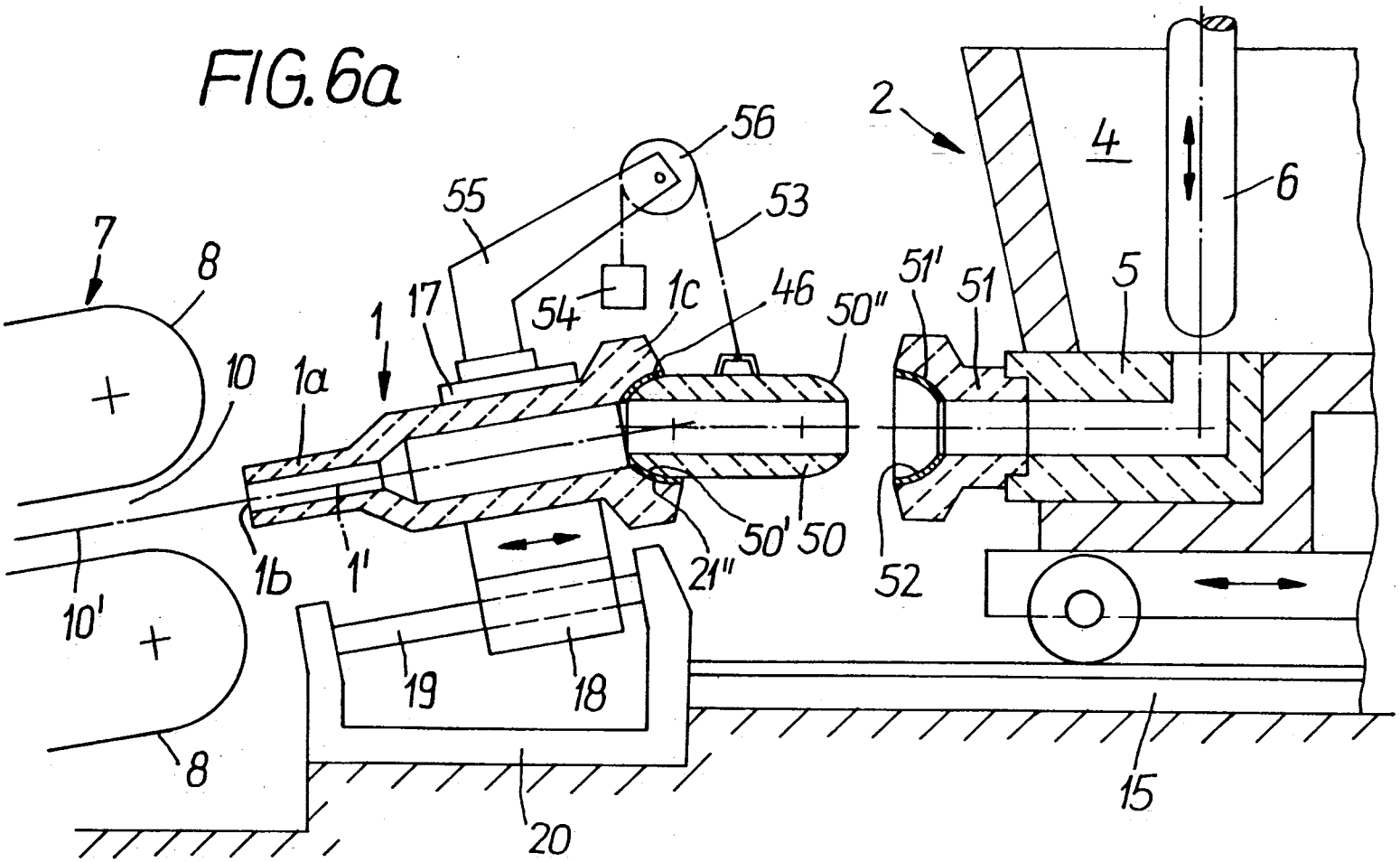
Figure 6B:
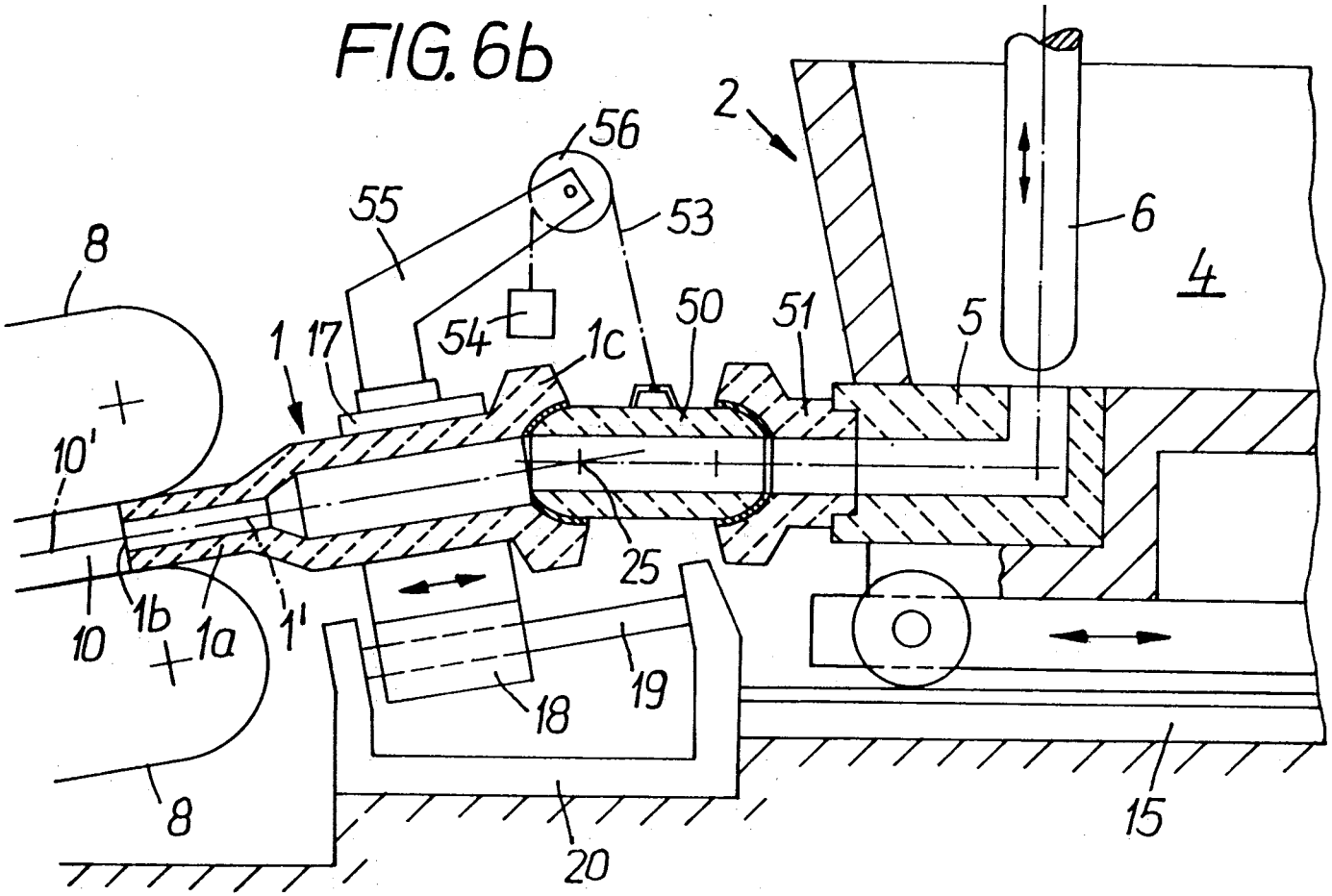

FIGS. 6*a* and 6*b* are highly schematic longitudinal sectional views of a feeding device including a compensating pipe according to a further embodiment of the invention, i.e. with the compensating pipe forming a ball joint with the pouring pipe as well as with the tundish, in the uncoupled and in the coupled state, respectively.

Figure 7:
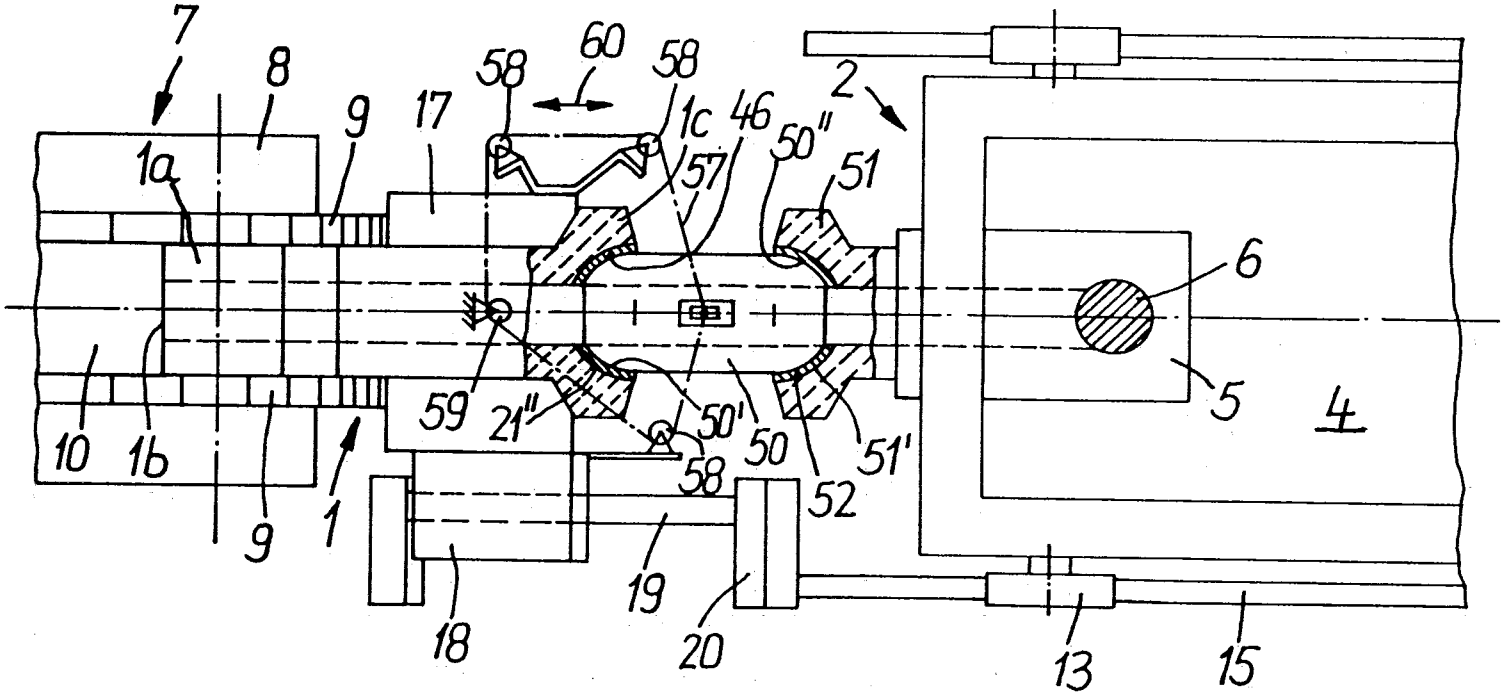

FIG. 7 is a schematic plan view, partially in section, of the arrangement of FIG. 6*b*.

DETAILED DESCRIPTION OF THE PREFERRED EMBODIMENTS

Figure 1:
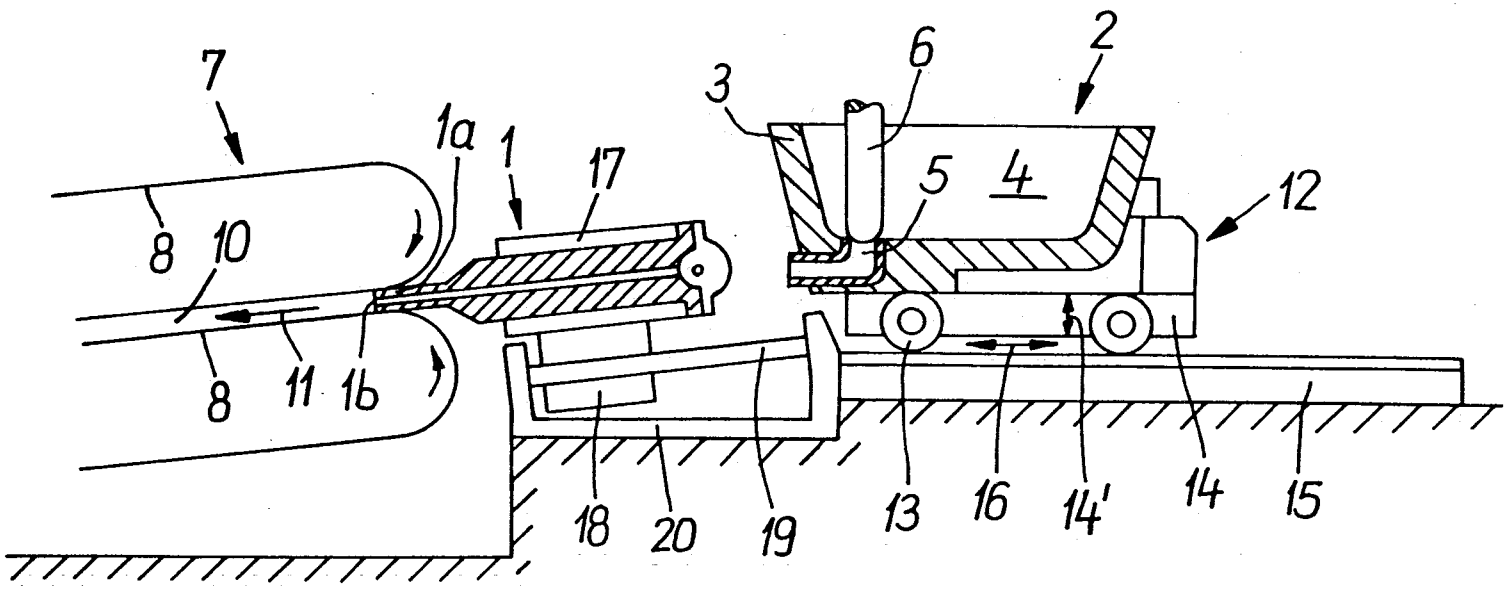
FIG. 1 is a highly schematic longitudinal sectional view of an arrangement to which the present invention relates including a tundish, a pouring pipe and a subsequently connected twin-belt caster, but with the connection between the tundish and the pouring pipe not being shown.

As shown in FIG. 1, the feeding device includes a pouring pipe or body 1 which cooperates with an upstream disposed tundish 2 whose melting chamber 4 is delimited by a side wall 3 and a bottom including a deflection block 5 which provides an outlet for the tundish in a direction toward the pouring pipe 1. Between the outlet of this block 5 and the entrance of the pouring pipe 1, an operationally reliable connection must be produced which will be described in greater detail below. The supply of steel melt from tundish 2 may be influenced by means of a height adjustable plug rod 6 disposed in the region of deflection block 5.

On its side facing twin-belt caster 7, the pouring pipe 1 is equipped with a spout or mouthpiece 1*a* whose frontal section and exit cross section 1*b* project between, and form a sealing gap with (see FIGS. 1 and 2) the mold walls of the twin-belt caster 7. These mold walls of the twin-belt caster 7, which in a known manner are composed of a pair of oppositely disposed (upper and lower) endless casting belts 8 and a pair of oppositely disposed endless links of lateral dams 9 (see FIG. 2) following alongside the casting belts 8, delimit a rectangular casting cavity 10 and are deflected or moved in the region of the casting cavity 10 to correspond with the casting direction (arrow 11). The longitudinal axis of the casting cavity 10 as well as that of the pouring pipe 1 are inclined by an angle of 6° with respect to the horizontal so as to be able to empty the twin belt caster 7.

In order to attain access to parts 1, 6 and 7, particularly for the purpose of heating them to a preheating temperature in the order of magnitude of 900° C., the tundish 2 is releasably fastened on a carriage 12 whose wheels 13 are equipped with eccentric bushings (not shown), and are adjustable in height, by way of these bushings, with respect to the vehicle frame 14, as indicated by the double arrow 14'. The carriage 12 is moveable by means of a displacement drive, for example in the form of an articulatedly connected hydraulic cylinder, along a guide path 15 in a direction toward and away from the pouring pipe 1, as indicated by the double arrow 16.

Pouring pipe 1 is movably mounted in a housing 17 of a carriage 18 which itself is supported on a stationary guide so as to be displaceable in both directions i.e., toward and away from the caster 7. The stationary guide is essentially composed of a guide rod 19 and a guide frame 20 supporting the guide rod (see FIG. 1).

Figure 2:
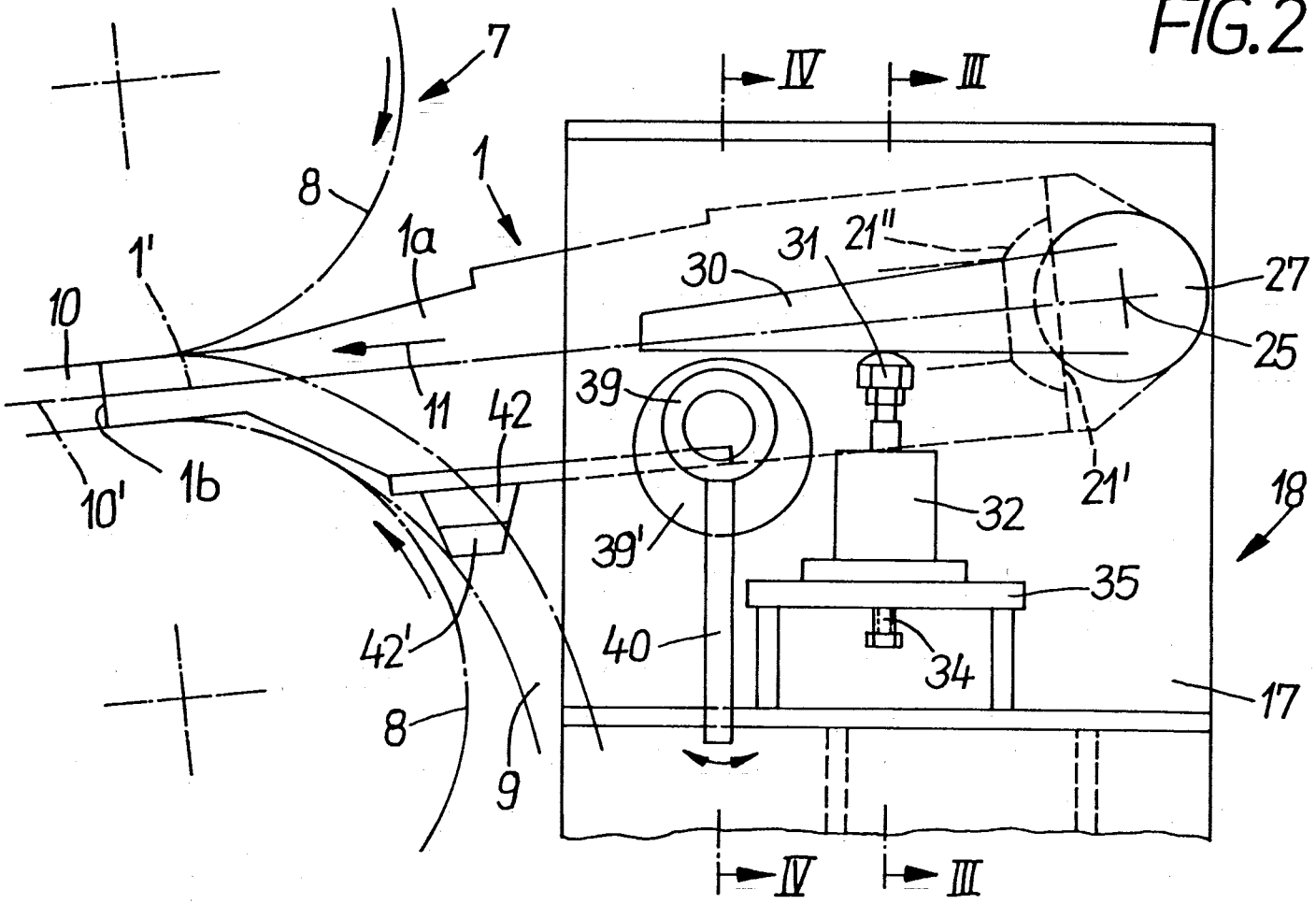
FIG. 2 is a highly schematic side view of a pouring unit, including a pouring pipe held in a carriage, for the arrangement of FIG. 1.
Figure 3:
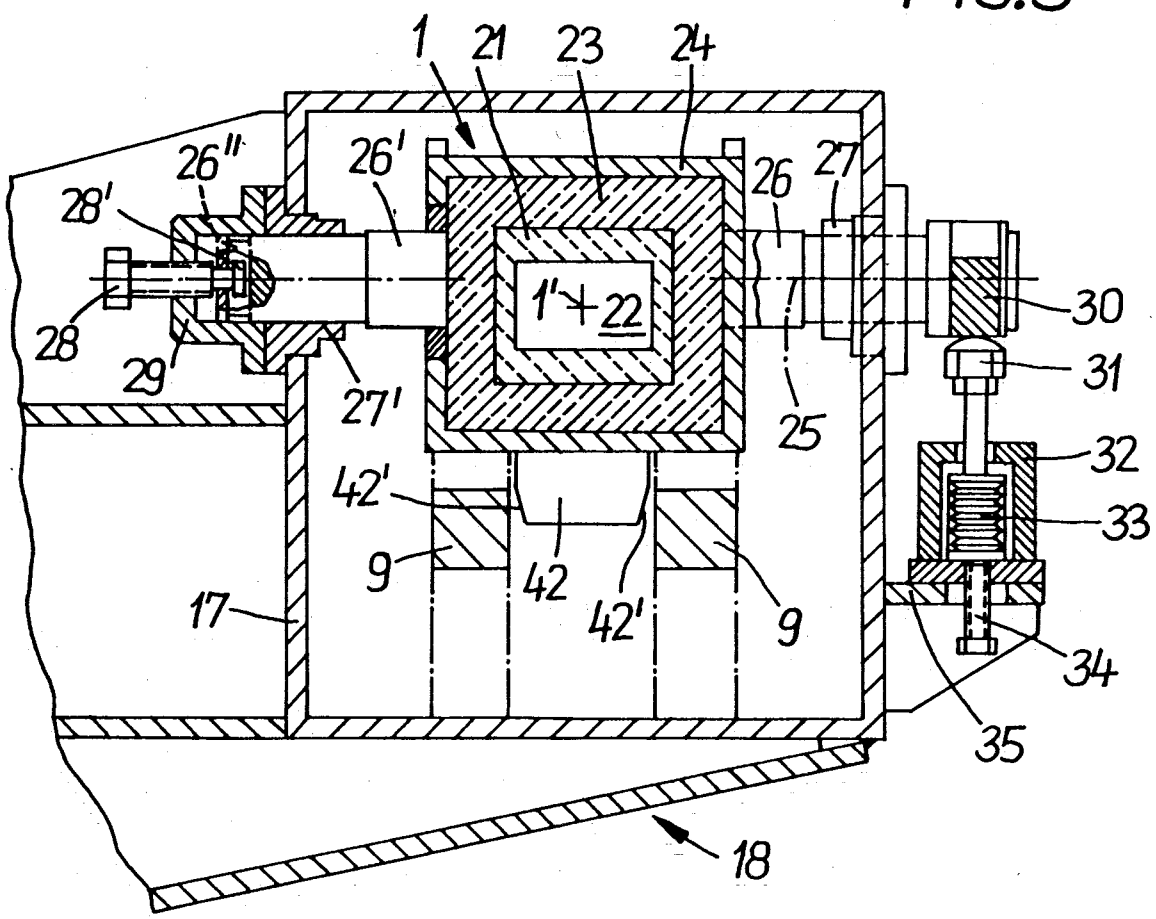
FIG. 3 is a sectional view along line III—III of FIG. 2.

As shown in FIGS. 2 and 3, the essential components of the pouring pipe 1, whose longitudinal axis is marked 1', are, in the region of carriage 18, a ceramic lining 21 provided with a casting bore 22, a heat insulating layer 23 which encloses the interior lining 22 toward the outside, and a steel jacket 24 serving as the supporting element. The pouring pipe 1 is mounted in the open ended housing 17 of carriage 18 so that it is rotatable about a horizontal pivot axis 25 by means of a pair of laterally extending pivot pins 26, 26' which are journaled in respective bearing bushings 27, 27' disposed in the respective opposite side walls of the housing 17.

Pivot pin 26', (on the left in FIG. 3) is equipped, outside the region of the associated bearing bushing 27', with a rectangular groove 26'' in which the adjustment head 28' of a lateral adjustment screw 28 engages with lateral play. Adjustment screw 28 itself is threadingly supported in an adjustment housing 29 which is connected with the end surface of the adjacent bearing bushing 27.

By rotating adjustment screw 28 with respect to adjustment housing 29, the pouring pipe 1, which is supported by pivot pins 26, 26' can be displaced laterally within housing 17 and can be fixed with a rough setting in the desired lateral position. This is of significance with respect to the alignment of mouthpiece 1*a* (see FIGS. 1 and 2) and in the cold state with respect to the side dams 9 (see FIG. 2), which project beyond casting belts 8 in the direction opposite to the casting direction. A play of about one millimeter is provided for alignment in the hot state.

For support, the pouring pipe 1 is provided with a rocker arm 30 which is rigidly fastened to the end of the Pivot pin 26 outside of the housing 17. This rocker arm 30 rests on an elastically supported vertically oriented buffer 31. The buffer 31 is movably supported in a housing 32 via a spring element in the form of a packet of plate springs 33. The tensioning force of the spring element can be increased or decreased with the aid of a tensioning screw 34 threaded into the bottom of housing 32. The housing 32 is fastened to a side console 35 of housing 17. By supporting the pouring pipe 1 in the manner of a rocker arm 30 resting on a resilient buffer 31, the differences in the forces caused by the different fill levels in the pouring pipe 1 are compensated.

Figure 4:
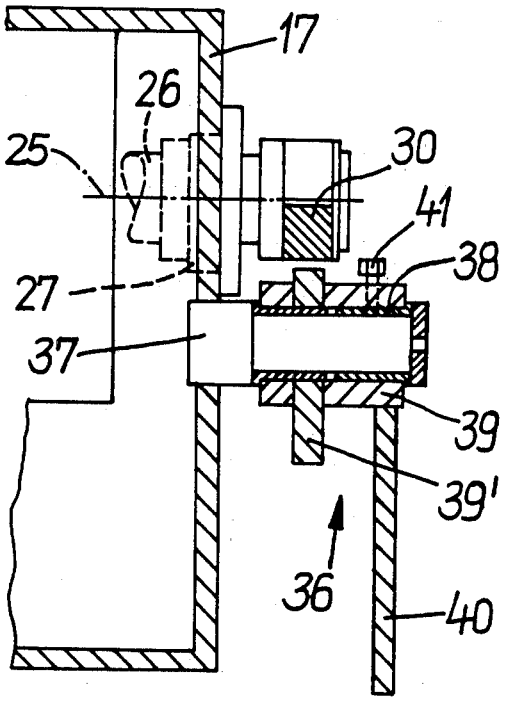
FIG. 4 is a partial sectional view along line IV—IV of FIG. 2.

As shown in FIGS. 3 and 4, on the same side of housing 17 (i.e. on the right in FIG. 3) as the rocker arm 30, an inclination adjusting eccentric 36 is attached to the side wall of the housing 17 behind the buffer 31, when seen in the casting direction, and below the pivot axis 25. The significant components of this eccentric 36 are an immoveably held supporting arm 37, a bearing bush 38 disposed on the arm 37, an eccentric bushing 39 with an eccentric disc 39', and a lever 40 which is connected to the bushing 39 so as to permit adjustment of the inclination eccentric. By rotating the eccentric bushing 39 via lever 40, eccentric disc 39' may be brought into contact with the already mentioned rocker arm 30.

By pivoting lever 40 either manually or by means of an adjustment drive, for example in the form of a hydraulic cylinder, the oblique position of the pouring pipe 1 with respect to the housing 17 can be varied infinitely over a wide range. The position of the eccentric bushing 39 with respect to the supporting arm 37 can be secured in a simple manner in that a set screw 41, which is threaded into bushing 39, passes through parts 39 and 38 to engage against supporting arm 37. The pouring pipe 1 of the feeding device according to the present invention thus includes, in addition to buffer 31, an inclination adjustment which facilitates the insertion of mouthpiece 1*a* between mold walls 8 and 9.

The position of inclination eccentric 36 and of the buffer 31 with respect to housing 17 can be seen particularly well in FIG. 2. In the casting position, mouthpiece 1*a* projects into the casting cavity or chamber 10 at an angle of 6°, with the longitudinal axis 1' of pouring pipe 1 coinciding with the longitudinal axis 10' of the casting cavity 10.

The advantage of the described embodiment is that by pivoting lever 40, the pouring pipe 1 can be brought, right from the start, into a position which permits effortless insertion of the mouthpiece 1*a* into the mold chamber or casting cavity 10. To aid in this purpose, as shown in FIGS. 2 and 3, a metal centering member 42 with precision worked sloped side surfaces 42' is attached to the underside of the pouring pipe 1. By lowering the pouring pipe 1, the side surfaces 42' extend into the area of the projecting side dams or mold walls 9 and bring pouring pipe 1 into the necessary lateral position in which centering member 42 finally comes to lie between the mold walls 9. Thereafter, it is merely necessary to move carriage 18 in the direction toward the twin belt caster 7 (i.e. to the left in FIG. 2).

As shown in FIG. 2, the end surface 21' of the ceramic inner lining 21 of the pouring pipe 1 which faces the tundish 2 (i.e. the end surface on the right in FIG. 2), also includes a concave sealing surface 21'' in the form of a ball socket for the ball joint. This end surface 21', when seen in the casting direction (arrow 11), lies behind pivot axis 25 of the pouring pipe 1. The fulcrum of the pouring pipe 1, which is movable in the manner of a rocker, and the center of the ball pivot associated with the sealing surface 21'' of the ball joint to be described below are thus identical with one another.

In the embodiment of the present invention shown in FIGS. 5*a* and 5*b*, a releasable connection between the pouring pipe 1 and the tundish 2, can be established via a short compensation pipe 43 in the form of a spherical segment, and a ceramic block 45 which is fastened by means of sealing mortar 44 to the deflection block 5 of the tundish 2 and forms, via a discharge bore 45', the outlet of the tundish 2.

The spherical segment shaped compensating pipe 43, whose center of rotation with respect to the interior lining 21 of pouring pipe 1 coincides with the pivot axis 25 of the pouring pipe 1 (see in this connection FIG. 2), is supported by way of its convexly curved exterior surface 43' and via a sealing mass 46 on the concavely curved sealing surface 21'' in the end surface 21' of the pouring pipe 1. Preferably, the sealing mass 46 is in the form of a fiber mat fastened to the concavely curved sealing surface 21''. Thus, the two cooperating sealing surfaces 43' and 21'' form an exit seal in the form of a ball joint at the discharge end of the compensating pipe 43.

As shown in FIGS. 5*a* and 5*b*, the compensating pipe is fastened to the pouring pipe 1 in an articulated manner so as to prevent separation of these two components. In order to provide such a fastening connection while still permitting the compensating pipe 43 to be able to move with respect to the pouring pipe 1 and adapt itself to the position of the ceramic block 45, the end or connecting section 1*c* of pouring pipe 1 is provided on its outer surface, via screw connections 47, with finger-like holding elements 48 which extend longitudinally beyond the end surface 21' and whose inwardly directed ends engage with play in groove-shaped recesses 43'' formed in the outer surface 43' of the compensating pipe 43.

The opposing frontal surfaces of the compensating pipe 43 and of the ceramic block 45 are each designed as planar surfaces 43''' and 45'', respectively, with the former being covered with a fiber mat 49 serving as a sealing mass.

By moving the pouring pipe 1 with the connected compensating pipe 43 and the tundish 2 with ceramic block 45 toward one another, a further seal can be formed by way of the two cooperating sealing surfaces 43''' and 45'' at the entrance of compensating pipe 43, with this seal permitting temperature caused shifts between the pouring pipe 1 and the tundish 2 since it is formed of planar surfaces. The ball joint forming the exit seal from the compensating pipe 43 here assures that the planar surface 43''' and fiber mat 49 are each able to adapt itself to the position of the planar sealing surface 45'' of the ceramic block 45.

When the pouring pipe 1 and the tundish 2 are moved apart, the compensating pipe 43 follows the movement of the pouring pipe 1 due to the presence of the holding elements 48. With this arrangement, the entrance seal with its components 43''', 49 and 45'' thus simultaneously forms a coupling point between the tundish 2 and the pouring pipe 1.

In the embodiment of FIGS. 6*a*, 6*b* and 7, the connection between pouring pipe 1 (shown purely schematically) and tundish 2 is established by means of a compensating pipe 50 having a longitudinal dimension of several hundred millimeters. As shown, one end of the compensating pipe 50, which is movably mounted on pouring pipe 1, forms an exit seal for the compensating pipe 50 with the connecting section 1*c* of the pouring pipe 1, which exit seal is designed as a ball joint in correspondence with the exit seal of the embodiment of FIG. 5. The convex sealing surface 50' in the form of a ball pin or pivot is here pivotally supported, through the intermediary of a fiber mat 46, on the sealing surface 21'' of the interior lining of the pouring pipe 1 which has the shape of a ball socket. The center of rotation of the sealing surface 50' coincides with the pivot axis 25 of the pouring pipe 1. On its end facing the tundish 2 (i.e. at the entrance of compensating pipe 50), the compensating pipe 50 is provided with a correspondingly configured convex sealing surface 50''. This surface 50'' is opposed by a concave sealing surface 51', in the form of the ball socket of a ceramic stone 51 fastened to guide or deflection block 5 and forming the outlet of the tundish 2. As shown, the surface 51' is covered by a fiber mat 52. These two sealing surfaces 50'' and 51' form an entrance seal for the compensating pipe 50 which seal, like the already described exit seal with sealing faces 21'' and 50', forms a ball joint (FIGS. 6*b* and 7).

Since in the embodiment of the present invention according to FIGS. 6*a*, 6*b* and 7, the connection between the pouring pipe 1 and the tundish 2 is provided with two ball joints, i.e., at both the entrance and the exit of compensating pipe 50, these ball joints are able to compensate for all displacements between the pouring pipe 1 and the tundish 2 in all directions without jeopardizing the operational reliability of the associated seals. Advisably, the compensating pipe 50 is provided or supported so as to constitute a movable component of the pouring pipe 1, and the entrance seal between the compensating pipe 50 and ceramic block 51, with cooperating sealing surfaces 50'' and 51', simultaneously serves as a coupling point through which components 1 and 2 can be separated and made accessible, for example so as to be able to heat the pouring pipe 1, the compensating pipe 50, the ceramic block 51 and the bottom channel block 5.

The support of the compensating pipe 50 on the pouring pipe 1 which permits setting of the height of the compensating pipe 50 relative to the tundish 2 is realized in that the compensating pipe 50 is additionally suspended from a cable 53 which is provided with a counterweight 54. The cable 53 is supported on carriage 18 of pouring pipe 1 by a stand 55 provided with a guide roller 56 over which the cable 53 passes. Advisably, this supporting arrangement for additionally supporting the compensating pipe 50 is designed in such a manner that the latter retains a once set height position with respect to the ceramic block 51 without any external influence.

The insertion process for producing the entrance seal between the sealing surfaces 50'' and 51' can be further simplified, as shown in FIG. 7, in that the compensating pipe 50 is additionally equipped with a lateral adjustment unit through which the lateral position of the compensating pipe 50 with respect to ceramic block 51, and thus with respect to tundish 2, can be varied.

For this purpose, the compensating pipe 50 is additionally fastened to a laterally extending endless cable 57 so as to be pivotal in both lateral directions. The cable 57 is supported by way of guide rollers 58 and 59, respectively mounted on the housing 17 of the carriage 18 of the pouring pipe 1. By displacing the cable 57 in the direction of double arrow 60, the compensating pipe 50 can be pivoted to the left or to the right and thus aligned in its lateral position with respect to ceramic block 51.

In view of the fact that the height and lateral position of compensating pipe 50 can be set in advance, it is possible without difficulty to produce the above-mentioned entrance seal between parts 50 and 51 by producing relative movement between the pouring pipe 1 and the tundish 2.

The connection required between the tundish 2 and the twin-belt caster 7 for initiating the casting process can be established in the following manner:

Starting with the heating position shown, for example, in FIG. 6*a*, in which parts 1, 50, 51 and 5 have been heated by means of burners, the pouring pipe 1 is brought into an oblique position by moving carriage 18 and suitably aligning it with respect to housing 17 so that its mouthpiece 1*a* can be inserted into the molding chamber 10 between the mold walls 8 and 9. The carriage 18 is here shifted in the direction toward the twin-belt caster 7 until it is supported at both sides of pouring pipe 1 at abutments (not shown) which fix the casting position (shown in FIGS. 6*b* and 7).

As soon as the pouring pipe 1 has reached the casting position, the tundish 2 is moved to the right until sealing surface 50'' inserts itself into the ceramic block 51 and, resting with its sealing surfaces 50' and 50'' against fiber mats 46 and 52, respectively, forms an exit and an entrance seal, respectively, with the associated sealing surfaces of the pouring pipe 1 and the ceramic block 51, each in the form of a ball joint. After clamping the tundish 2 in the attained casting position, the casting process can be initiated once the steel melt has been filled into melt chamber 4 and plug rod 6 has been raised.

Temperature caused deformations of the parts connected together by way of compensating pipe 50, and shifts in their height and lateral position can be compensated without interference with the casting process because the connection between pouring pipe 1 and tundish 2 is configured as a multiple moveable joint.

The sensitive alignment of the pouring pipe 1 with respect to the mold walls 8 and 9 defining the casting cavity 10 is necessary because, during the casting process, a sealing gap of the order of magnitude of a few tenths of a millimeter must be maintained in the region of the mouthpiece 1*a*. This is of particular significance if the steel melt, in order to produce a high quality cast product, is cast under pressure. The level of the melt bath within the tundish 2 then always has a height which lies above the exit cross section 1*b* in casting cavity 10. This pressure casting method requires that the seal between the mouthpiece 1*a* and the mold walls is able to withstand the increased metallostatic pressure in this region.

The advantage realized with the present invention is that, by way of a connection between the pouring pipe 1 and the tundish 2 in the form of a multiple joint, changes in position can be compensated without the mouthpiece 1*a* being displaced with respect to the mold walls surrounding it.

The heat insulating layer 23 (see FIG. 3) by means of which the ceramic interior lining 21 of the pouring pipe 1 is resiliently supported in the steel jacket 24, is preferably made of aluminum oxide fibers, aluminum silicate fibers and an organic binder (proportions: 72% $Al_2O_3$, 21% $SiO_2$, remainder binder). Above a temperature of about 400° C., the binder will change to the gaseous state so that the heat insulating layer then consist only of the components $Al_2O_3$ and $SiO_2$.

The ceramic interior lining 21 (of pouring pipe 1), aside from its mouthpiece 1*a* in the region of the mold walls, is composed of amorphous silicic acid ($SiO_2$), or alumina ($Al_2O_3$). This applies correspondingly for the compensating pipes 43 and 50 and the ceramic blocks 45 and 51 cooperating therewith.

The mouthpiece 1*a*, at least in the region in which it forms a tight sealing gap with the mold walls 8 and 9, is composed of boron nitride (BN).

The fiber mats 46, 49 and 52, respectively have a thickness of approximately 1.5 mm and are composed of $Al_2O_3$, $SiO_2$ and binder. These mats serve to compensate for manufacturing inaccuracies of the respectively cooperating sealing surfaces and thus assure the operational reliability of the respective seals.

It will be understood that the above description of the present invention is susceptible to various modifications, changes and adaptations, and the same are intended to be comprehended within the meaning and range of equivalents of the appended claims.

What is claimed is:

1. A feeding device for introducing molten steel into a twin-belt caster having mold walls which move exclusively in the casting direction, said feeding device comprising: a casting unit including a pouring pipe having a mouthpiece at one end which can extend between and form a sealing gap with the mold walls of a twin-belt caster, a first carriage means disposed for movement toward and away from the locus of a twin-belt caster, and means for mounting said pouring pipe on said first carriage means so that said pouring pipe is rotatable about a horizontal pivot axis and is laterally adjustable transversely to its longitudinal extent; a tundish having an outlet; a second carriage means, disposed upstream of said first carriage means and independently moveable toward and away from said first carriage means, for supporting said tundish so that it is adjustable in height; and means for connecting said outlet of said tundish to the other end of said pouring pipe to permit molten steel to flow from said tundish through said pouring pipe, said connecting means including a compensating pipe having first and second sealing surfaces at its opposed ends, first sealing means, including said first sealing surface and a cooperating correspondingly shaped sealing surface on the other end of said pouring pipe, for sealingly connecting said compensating pipe to said pouring pipe such that said first sealing surface and said sealing surface on said pouring pipe are moveable relative to one another, and a second sealing means, including said second sealing surface and a correspondingly shaped sealing surface at said outlet of said tundish, for sealingly connecting said compensating pipe to said tundish such that said second sealing surface and said sealing surface on said tundish are moveable relative to one another.

2. A feeding device as defined in claim 1, wherein at least one of said first and second sealing means comprises a ball joint having a ball socket and a ball pivot, each forming one of said sealing surfaces of the respective sealing means.

3. A feeding device as defined in claim 2, wherein each of said first and second sealing means comprises a said ball joint.

4. A feeding device as defined in claim 2, wherein at least one of said first and second sealing means simultaneously serves as a coupling point for the associated said sealing surfaces of the respective said sealing means.

5. A feeding device as defined in claim 4, further comprising means for fastening said compensating pipe to one of said pouring pipe and said tundish as a moveable component thereof.

6. A feeding device as defined in claim 5, wherein the one of said first and second sealing means associated with the one of said pouring pipe and said tundish to which said compensating device is fastened as a moveable component comprises said ball joint, and the other of said first and second sealing means serves as said coupling point.

7. A feeding device as defined in claim 5, wherein said means for fastening said compensating pipe fastens same to said pouring pipe as a movable component thereof.

8. A feeding device as defined in claim 7, wherein said means for fastening articulates said compensating pipe to said pouring pipe.

9. A feeding device as defined in claim 8, wherein said first sealing means includes said ball joint, and said second sealing surfaces of said compensating pipe and said sealing surface of said tundish are planar surfaces.

10. A feeding device as defined in claim 9, wherein said first sealing surface comprises said ball pivot and said compensating pipe is in the form of a spherical segment having a short longitudinal dimension.

11. A feeding device as defined in claim 9, wherein said means for fastening said compensating pipe including a plurality of finger-like longitudinally extending holding elements which are fastened to said pouring pipe and which engage with play in groove-shaped recesses provided in the peripheral surface of said the compensating pipe.

12. A feeding device as defined in claim 7, wherein said first and second sealing means each comprise a said ball joint.

13. A feeding device as defined in claim 12, further comprising means mounted on said first carriage means for supporting said compensating pipe so that it is adjustable in height with respect to said outlet of said tundish.

14. A feeding device as defined in claim 13, further comprising a lateral adjustment means connected to said compensating pipe for adjusting the lateral position of said compensating pipe with respect to said outlet of said tundish.

15. A feeding device as defined in claim 1, wherein one of said sealing surfaces of each of said first and second sealing means is covered with a fiber mat which is essentially composed of $Al_3O_3$ and $SiO_2$.

* * * * *